US010890865B2

(12) United States Patent
Yabe et al.

(10) Patent No.: US 10,890,865 B2
(45) Date of Patent: Jan. 12, 2021

(54) INTERMEDIATE TRANSFER MEDIUM

(71) Applicant: Dai Nippon Printing Co., Ltd., Tokyo (JP)

(72) Inventors: Suguru Yabe, Tokyo (JP); Emi Matsuba, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 16/640,219

(22) PCT Filed: May 9, 2019

(86) PCT No.: PCT/JP2019/018479

§ 371 (c)(1),
(2) Date: Feb. 19, 2020

(87) PCT Pub. No.: WO2020/003751

PCT Pub. Date: Jan. 2, 2020

(65) Prior Publication Data

US 2020/0292970 A1 Sep. 17, 2020

(30) Foreign Application Priority Data

Jun. 29, 2018 (JP) ..... 2018-125436

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS

2013/0164463 A1* 6/2013 Yoda ..... B41M 5/529
428/32.39
2015/0328913 A1* 11/2015 Sakamoto ..... B41M 5/42
428/32.5

(Continued)

FOREIGN PATENT DOCUMENTS

JP 2004-351656 A1 12/2004
JP 2005-219452 A1 8/2005

(Continued)

OTHER PUBLICATIONS

International Search Report and Written Opinion (Application No. PCT/JP2019/018479) dated Jun. 18, 2019.

*Primary Examiner* — Sandra Brase
(74) *Attorney, Agent, or Firm* — Burr & Brown, PLLC

(57) ABSTRACT

An object of the present invention is to provide an intermediate transfer medium having high durability, as well as high smudge resistance and image stability. The intermediate transfer medium of the present invention includes: a substrate, and a transfer layer including a first intermediate layer, a second intermediate layer and a receiving layer; in which the first intermediate layer contains a (meth)acrylic polyol resin with a glass transition temperature of 80° C. or higher; in which the second intermediate layer contains a polyester with a glass transition temperature of 45° C. or higher and a filler with a mean particle diameter of 2 μm or more and 5 μm or less; and in which the content of the filler in the second intermediate layer is 0.5% by mass or more and 5% by mass or less.

7 Claims, 3 Drawing Sheets

(56) References Cited

U.S. PATENT DOCUMENTS

| | | | |
|---|---|---|---|
| 2016/0067997 | A1 | 3/2016 | Oomura et al. |
| 2016/0082707 | A1 | 3/2016 | Oomura et al. |

FOREIGN PATENT DOCUMENTS

| | | | |
|---|---|---|---|
| JP | 2005-280042 | A1 | 10/2005 |
| JP | 2015-091633 | A1 | 5/2015 |
| JP | 2015-091636 | A1 | 5/2015 |

* cited by examiner

INTERMEDIATE TRANSFER MEDIUM

TECHNICAL FIELD

The present invention relates to an intermediate transfer medium.

BACKGROUND OF THE INVENTION

Various methods for thermal transfer recording have been conventionally known. Recently, sublimation thermal transfer recording methods have been broadly used, in which a thermal transfer sheet having a dye layer containing sublimation dyes and a transfer object are stacked, then the thermal transfer sheet is heated with a thermal head mounted in a thermal transfer printer, and thereby the sublimation dyes in the dye layer are transferred onto the transfer object to form an image and obtain a printed matter.

Image formation by sublimation thermal transfer recording methods may be difficult to achieve depending on the surface profile or the like of transfer objects. In such a case, intermediate transfer media containing a transfer layer have been used to perform an image formation.

Image formation using an intermediate transfer medium is performed by heating a thermal transfer sheet and transferring sublimation dyes in a dye layer contained in the thermal transfer sheet to a receiving layer constituting a transfer layer contained in the intermediate transfer medium to form an image, and then heating the intermediate transfer medium to transfer the transfer layer to a transfer object.

In addition, in order to improve the durability, e.g., wear resistance and solvent resistance, of images formed on a printed matter, intermediate transfer media further provided with a protective layer containing resin materials such as polyesters as a transfer layer-constituting layer have been conventionally suggested.

Recently, high-speed transfer of a transfer layer contained in an intermediate transfer medium has been performed in order to improve the productivity of printed matters. However, because resin materials that are contained in a protective layer and softened by heat during transfer may not able to keep up with the transfer rate, fine cracks may be generated, resulting in smudge in and quality degradation of the printed matter, which leads to a demand for improvement. The occurrence of smudge has also been problematic in case where a mechanism for changing the transport directions of transfer objects and printed matters is provided.

SUMMARY OF THE INVENTION

Problems to Be Solved by the Invention

The present inventors have now found that an intermediate transfer medium including a substrate, and a transfer layer including a first intermediate layer, a second intermediate layer and a receiving layer, in which the first intermediate layer contains a (meth)acrylic polyol resin having a glass transition temperature within a specific range, and in which the second intermediate layer contains a polyester having a glass transition temperature within a specific range and a filler having a mean particle diameter and a content within specific ranges, can prevent the occurrence of smudge while maintaining high durability of the intermediate transfer medium.

The present inventors have also found that the intermediate transfer medium can be used to reduce generation of surface ruggedness in the printed matter to be obtained and prevent occurrence of image unevenness due to the unevenness (hereinafter may be referred to as image stability).

The present invention is based on the above-described findings, and a problem to be solved by the invention is to provide an intermediate transfer medium having high durability as well as high smudge resistance and image stability.

Means for Solving the Problems

The intermediate transfer medium of the present invention comprises: a substrate, and a transfer layer comprising a first intermediate layer, a second intermediate layer and a receiving layer; wherein the first intermediate layer contains a (meth)acrylic polyol resin with a glass transition temperature of 80° C. or higher; wherein the second intermediate layer contains a polyester with a glass transition temperature of 45° C. or higher and a filler with a mean particle diameter of 2 μm or more and 5 μm or less; and wherein the content of the filler in the second intermediate layer is 0.5% by mass or more and 5% by mass or less.

In one embodiment, the filler is (meth)acrylic resin particle.

In one embodiment, the shape of the filler is spherical.

In one embodiment, the (meth)acrylic polyol resin is a cured (meth)acrylic polyol resin obtained by curing a (meth) acrylic polyol resin having a Tg of 80° C. or higher with a curing agent.

In one embodiment, the curing agent is an isocyanate compound, and the molar equivalent ratio (—NCO/—OH) of isocyanate groups in the isocyanate compound to hydroxy groups in the (meth)acrylic polyol resin is 0.2 or more and 3 or less.

In one embodiment, the glass transition temperature of the polyester is 50° C. or higher and 80° C. or lower.

In one embodiment, the sum of the thickness of the second intermediate layer and the thickness of the receiving layer is 1 μm or more and 9 μm or less.

Effect of the Invention

According to the present invention, an intermediate transfer medium having high durability as well as high smudge resistance and image stability can be provided.

DETAILED DESCRIPTION OF THE INVENTION (Intermediate Transfer Medium)

Figure 1:
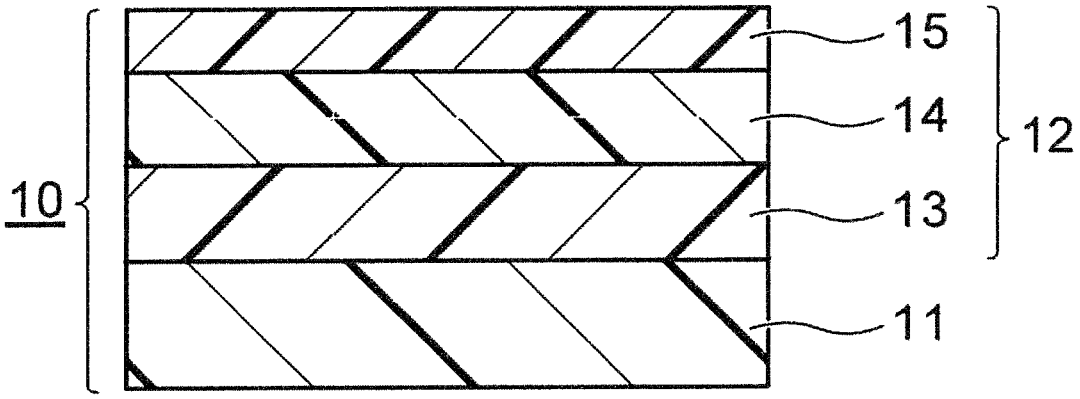
FIG. 1 is a schematic sectional view representing an intermediate transfer medium in one embodiment of the present invention.

The intermediate transfer medium 10 of the present invention as shown in FIG. 1 includes a substrate 11 and a transfer layer 12, and the transfer layer 12 includes a first intermediate layer 13, a second intermediate layer 14 and a receiving layer 15.

Figure 2:
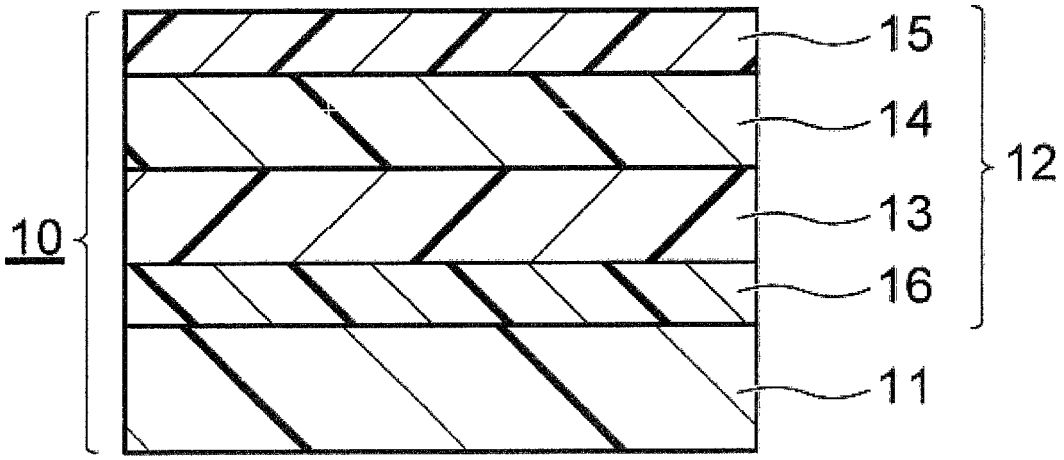
FIG. 2 is a schematic sectional view representing an intermediate transfer medium in one embodiment of the present invention.

In one embodiment, the transfer layer 12 provided in the intermediate transfer medium 10 of the present invention as shown in FIG. 2 includes a peeling layer 16 under the first intermediate layer 13.

Figure 3:
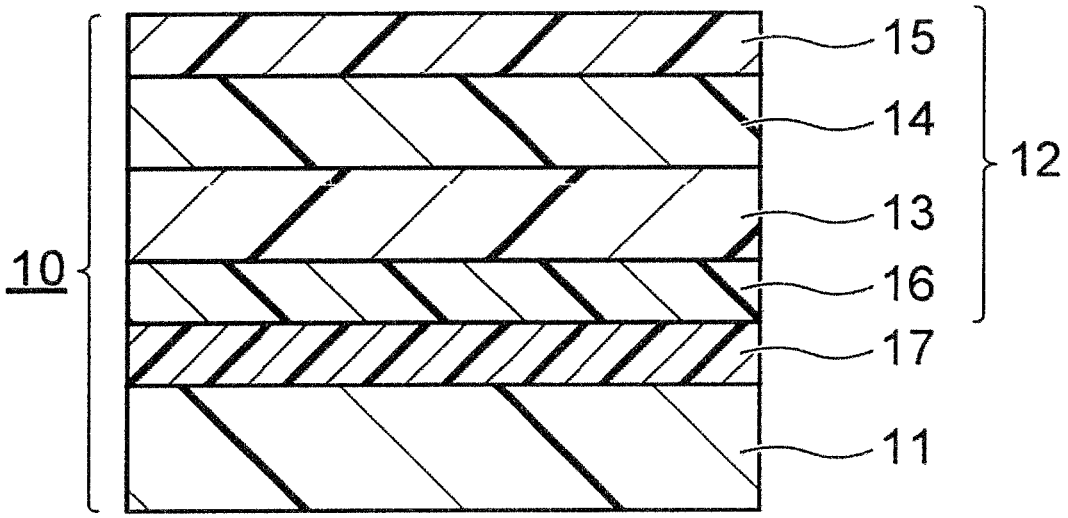
FIG. 3 is a schematic sectional view representing an intermediate transfer medium in one embodiment of the present invention.

In one embodiment, the intermediate transfer medium 10 of the present invention as shown in FIG. 3 includes a release layer 17 between the substrate 11 and the transfer layer 12.

Figure 4:
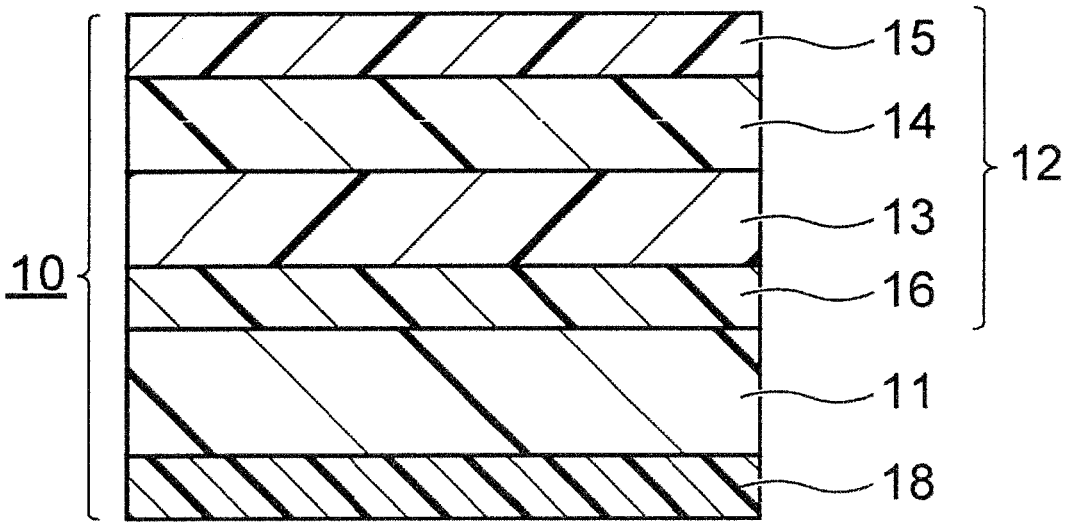
FIG. 4 is a schematic sectional view representing an intermediate transfer medium in one embodiment of the present invention.

In one embodiment, the intermediate transfer medium 10 of the present invention as shown in FIG. 4 includes a backing layer 18 on the surface of the substrate 11 opposite to the surface provided with the transfer layer 12.

Hereinafter, the layers provided in the intermediate transfer medium of the present invention will be described.

(Substrate)

The substrate has a heat resistance with which the substrate can resist a heat energy applied during thermal transfer (e.g., heat from thermal head), and a mechanical strength with which the substrate can support a layer provided on the substrate.

Examples of the substrate which can be used include paper substrates such as woodfree paper, art paper, coated paper, resin coated paper, cast coated paper, paper board, synthetic paper and impregnated paper; and films composed of the following resins (hereinafter simply referred to as "resin films"): polyesters such as polyethylene terephthalate (PET), polybutylene naphthalate (PBT), polyethylene naphthalate (PEN), poly(1,4-cyclohexylene dimethylene terephthalate), and terephthalate-cyclohexanedimethanol-ethylene glycol copolymer; polyamides such as nylon 6 and nylon 6,6; polyolefins such as polyethylene (PE), polypropylene (PP) and polymethylpentene; vinyl resins such as polyvinyl chloride, polyvinyl alcohol (PVA), polyvinyl acetate, vinyl chloride-vinyl acetate copolymer and polyvinylpyrrolidone (PVP); polyvinyl acetals such as polyvinyl acetoacetal and polyvinyl butyral; (meth)acrylic resins such as polyacrylate, polymethacrylate and polymethyl methacrylate; imide resins such as polyimide and polyetherimide; cellulose resins such as cellophane, cellulose acetate, nitrocellulose, cellulose acetate propionate (CAP) and cellulose acetate butyrate (CAB); styrene resins such as polystyrene (PS); polycarbonates; and ionomer resins. The resin film may be a stretched or unstretched film. Preferably, a stretched film stretched in a uniaxial or biaxial direction is used from the viewpoint of strength.

As used herein, the term "(meth)acryl" includes both "acryl" and "methacryl."

As used herein, the term "(meth)acrylate" includes both "acrylate" and "methacrylate."

A laminate composed solely of the paper substrate described above, a laminate composed only of the resin film described above, or a laminate of the paper substrate and the resin film described above can be used as the substrate.

These laminates can be produced by use of methods such as dry lamination method, wet lamination method and extrusion method.

The substrate may have any thickness, e.g., 1 μm or more and 300 μm or less.

(Transfer Layer)

The transfer layer includes a first intermediate layer, a second intermediate layer and a receiving layer. In one embodiment, the transfer layer further includes a peeling layer under the first intermediate layer.

(First Intermediate Layer)

The first intermediate layer contains at least one (meth) acrylic polyol resin having a glass transition temperature (Tg) of 80° C. or higher.

The Tg of the (meth)acrylic polyol resin is preferably 80° C. or higher and 110° C. or lower, more preferably 85° C. or higher and 105° C. or lower. When the Tg is within the range, the durability of the intermediate transfer medium can be improved.

In the present invention, the Tg is a value determined by differential scanning calorimetry (DSC) according to JIS K 7121.

In the present invention, the (meth)acrylic polyol resin means a resin comprising at least one (meth)acrylic ester having a hydroxy group as a polymer component.

Examples of the (meth)acrylic ester having a hydroxy group include 2-hydroxyethyl (meth)acrylate, 3-hydroxypropyl (meth)acrylate, 2-hydroxybutyl (meth)acrylate, and 2-hydroxy-3-phenoxypropyl (meth)acrylate.

The content of the (meth)acrylic ester having a hydroxy group in the (meth)acrylic polyol resin is preferably 8% by mass or more, more preferably 10% by mass or more, with respect to the entire structural units. When the Tg is within the range, the durability of the intermediate transfer medium can be improved.

The (meth)acrylic polyol resin may comprise one or two or more monomers other than (meth)acrylic esters as polymer components, including alkyl (meth)acrylate esters such as methyl (meth)acrylate, ethyl (meth)acrylate, butyl (meth) acrylate, 2-ethylhexyl (meth)acrylate, and octyl (meth)acrylate; styrene, alpha-methylstyrene, vinyltoluene, acrylamide, methacrylamide, vinyl acetate and maleic anhydride.

Preferably, the hydroxyl value of the (meth)acrylic polyol resin is within a range of 10 mgKOH/g or more and 100 mgKOH/g or less. When the hydroxyl value is within the range, the intermediate transfer medium can have further improved durability and improved foil cutting properties, and the occurrence tailing and the like can be prevented.

As used herein, the term "hydroxyl value" of an acrylic polyol resin means the amount in mg of potassium hydroxide required for acetylating hydroxyl groups contained in 1 g of the (meth)acrylic polyol resin. The hydroxyl value can be determined by preparing a pyridine solution containing acetic anhydride using the acrylic polyol resin according to JIS K 0070, acetylating hydroxy groups, hydrolyzing excess acetylating reagent with water, and titrating the produced acetic acid with potassium hydroxide.

The weight average molecular weight (Mw) of the (meth) acrylic polyol resin is preferably 8,000 or more and 70,000 or less, more preferably 10,000 or more and 50,000 or less. When the weight average molecular weight is within the range, the intermediate transfer medium can have further improved durability and improved foil cutting properties.

Here, the MW of a resin means a value measured by gel permeation chromatography with polystyrene as a standard substance, and is measured by a method according to JIS K 7252-1.

Preferably, the (meth)acrylic polyol resin is a cured (meth)acrylic polyol resin obtained by curing a (meth) acrylic polyol resin having a Tg of 80° C. or higher with a curing agent. When the (meth)acrylic polyol resin is the cured (meth)acrylic polyol resin, the durability of the intermediate transfer medium can be further improved.

Examples of the curing agent include aliphatic amine compounds, cyclic aliphatic amine compounds, aromatic amine compounds; metal chelates such as titanium chelates, zirconium chelates and aluminum chelates; acid anhydrides and isocyanate compounds.

Examples of the isocyanate compounds include xylylene diisocyanate, isophorone diisocyanate, hexamethylene diisocyanate, p-phenylene diisocyanate, 1-chloro-2,4-phenyl diisocyanate, 2-chloro-1,4-phenyl diisocyanate, 2,4-toluene diisocyanate, 2,6-toluene diisocyanate, 1,5-naphthalene diisocyanate, tolidine diisocyanate, p-phenylene diisocyanate, trans-cyclohexane, 1,4-diisocyanate, 4,4'-biphenylene diisocyanate, triphenyl methane triisocyanate and 4,4',4"-trimethyl-3,3',2'-triisocyanate-2,4,6-triphenylcyanurate. In particular, xylylene diisocyanate, isophorone diisocyanate and hexamethylene diisocyanate are preferable. These isocyanate compounds can prevent yellowing and maintain the transparency of the first intermediate layer.

When the curing agent is the isocyanate compound, the molar equivalent ratio (—NCO/—OH) of isocyanate groups in the isocyanate compound to hydroxy groups in the (meth)acrylic polyol resin is preferably 0.2 or more and 3 or less, more preferably 0.3 or more and 2 or less. When the molar equivalent ratio is within the range, the intermediate transfer medium can have further improved smudge resistance and improved foil cutting properties.

The content of the (meth)acrylic polyol resin in the first intermediate layer is preferably 50% by mass or more and 99% by mass or less, more preferably 70% by mass or more and 95% by mass or less. When the content is within the range, the intermediate transfer medium can have further improved durability and improved foil cutting properties.

Within a range not impairing the characteristics of the present invention, the first intermediate layer can contain other resin materials such as (meth)acrylic polyol resins, polyesters, polyamides, polyolefins, vinyl resins, polyvinyl acetals, (meth)acrylic resins, imide resins, cellulose resins, styrene resins, polycarbonates and ionomer resins that have a glass transition temperature (Tg) of less than 80° C.

Within a range not impairing the characteristics of the present invention, additives such as fillers, plasticizers, antistatics, ultraviolet absorbers, inorganic particles, organic particles, mold lubricants, and dispersant can be contained.

The thickness of the first intermediate layer is preferably 0.5 μm or more and 5 μm or less, more preferably 1 μm or more and 4 μm or less. When the thickness is within the range, the intermediate transfer medium can have further improved durability and improved foil cutting properties.

The first intermediate layer can be formed by dispersing or dissolving the above-described materials in water or a suitable solvent to prepare a coating liquid, applying the coating liquid on a substrate or the like by known means, such as by roll coating, reverse roll coating, gravure coating, reverse gravure coating, bar coating and rod coating to form a film, and drying the film.

(Second Intermediate Layer)

The second intermediate layer contains at least one polyester having a Tg of 45° C. or higher and at least one filler having a mean particle diameter of 2 μm or more and 5 μm or less.

In the present invention, the polyester means a copolymer of a dicarboxylic acid compound and a diol compound.

Examples of the dicarboxylic acid compound include malonic acid, succinic acid, glutaric acid, adipic acid, suberic acid, sebacic acid, dodecanedioic acid, eicosanedioic acid, pimelic acid, azelaic acid, methylmalonic and ethylmalonic acids, adamantanedicarboxylic acid, norbornenedicarboxylic acid, cyclohexanedicarboxylic acid, decalindicarboxylic acid, terephthalic acid, isophthalic acid, phthalic acid, 1,4-naphthalenedicarboxylic acid, 1,5-naphthalenedicarboxylic acid, 2,6-naphthalenedicarboxylic acid, 1,8-naphthalenedicarboxylic acid, 4,4'-diphenyldicarboxylic acid, 4,4'-diphenyletherdicarboxylic acid, 5-sodiumsulfoisophthalic acid, phenylindandicarboxylic acid, anthracenedicarboxylic acid, phenanthrenedicarboxylic acid, 9,9'-bis(4-carboxyphenyl)fluorene and ester derivatives thereof.

Examples of the diol compound include ethylene glycol, 1,2-propanediol, 1,3-propanediol, butanediol, 2-methyl-1,3-propanediol, hexanediol, neopentylglycol, cyclohexanedimethanol, cyclohexanediethanol, decahydronaphthalenedimethanol, decahydronaphthalenediethanol, norbornanedimethanol, norbornanediethanol, tricyclodecanedimethanol, tricyclodecaneethanol, tetracyclododecanedimethanol, tetracyclododecanediethanol, decalindimethanol, decalindiethanol, 5-methylol-5-ethyl-2-(1,1-dimethyl-2-hydroxyethyl)-1,3-dioxane, cyclohexanediol, bicyclohexyl-4,4'-diol, 2,2-bis(4-hydroxycyclohexyl)propane, 2,2-bis(4-(2-hydroxyethoxy)cyclohexyl)propane, cyclopentanediol, 3-methyl-1,2-cyclopentadiol, 4-cyclopentene-1,3-diol, adamantanediol, para-xylylene glycol, bisphenol A, bisphenol S, styrene glycol, trimethylolpropane, and pentaerythritol.

Within a range not impairing the characteristics of the present invention, the polyester may contain monomers other than dicarboxylic acid compounds and diol compounds. The content of the monomers is preferably 40% by mass or less, more preferably 30% by mass or less, still more preferably 20% by mass or less with respect to the entire structural units.

In the present invention, the Tg of the polyester is preferably 50° C. or higher and 80° C. or lower, more preferably 55° C. or higher and 70° C. or lower. When the Tg is within the range, the intermediate transfer medium can have further improved smudge resistance and durability, as well as improved foil cutting properties and wrinkle resistance during transportation.

The number average molecular weight (Mn) of the polyester is preferably 2,000 or more and 25,000 or less, more preferably 8,000 or more and 20,000 or less. When the Mn is within the range, the intermediate transfer medium can have further improved durability and improved foil cutting properties.

Here, the Mn of a resin means a value measured by gel permeation chromatography with polystyrene as a standard substance, and is measured by a method according to JIS K 7252-1.

The content of the polyester in the second intermediate layer is preferably 50% by mass or more and 99.5% by mass or less, more preferably 70% by mass or more and 98% by mass or less. When the content is within the range, the intermediate transfer medium can have further improved smudge resistance and durability, as well as improved foil cutting properties and wrinkle resistance during transportation.

The filler may be an organic or inorganic filler, or a combination thereof.

Examples of the organic filler include particles (resin particles) composed of resins such as melamine resins, benzoguanamine resins, (meth)acrylic resins, polyamides, fluorine resins, phenol resins, styrene resins, polyolefins, silicone resins and copolymers of monomers constituting the resins. Among them, particles composed of (meth)acrylic resins are particularly preferred from the viewpoint of durability.

Examples of the inorganic filler include clay minerals such as talc and kaolin, carbonates such as calcium carbonate and magnesium carbonate, hydroxides such as aluminum hydroxide and magnesium hydroxide, sulfates such as calcium sulfate, oxides such as silica, graphite, niter, and boron nitride.

The shape of the filler may be any of spherical, spheroid, cylindrical and prismatic shapes, and may be preferably spherical from the viewpoints of the smudge resistance of the intermediate transfer medium and the durability of the transfer layer.

More specifically, the term "spherical" as used herein means that the sphericity of the filler is 1 or more and 1.3 or less. More preferably, the sphericity is 1 or more and 1.1 or less.

As used herein, the term "sphericity" means the longest diameter/shortest diameter of the filler.

The filler may be treated on the surface with a surface treatment agent such as a silane coupling agent.

The mean particle diameter of the filler is preferably 3.8 μm or less, more preferably 3.5 μm or less. When the mean particle diameter is within the range, the intermediate transfer medium can have further improved smudge resistance and image stability, as well as improved wrinkle resistance during transportation.

As used herein, the term "mean particle diameter" refers to mean volume diameter and is measured according to JIS Z 8819-2.

The content of the filler in the second intermediate layer is 0.5% by mass or more and 5% by mass or less, preferably 0.7% by mass or more and 4.7% by mass or less, more preferably 1% by mass or more and 4.5% by mass or less. When the content is within the range, the intermediate transfer medium can have further improved smudge resistance, durability and image stability, as well as improved wrinkle resistance during transportation.

Within a range not impairing the characteristics of the present invention, the second intermediate layer can contain other resin materials such as polyesters, polyamides, polyolefins, vinyl resins, polyvinyl acetals, (meth)acrylic resins, imide resins, cellulose resins, styrene resins, polycarbonates and ionomer resins that have a Tg of less than 45° C., and additives described above.

The thickness of the second intermediate layer is preferably 0.5 μm or more and 4.5 μm or less, more preferably 1 μm or more and 3 μm or less. When the thickness is within the range, the intermediate transfer medium can have further improved smudge resistance, durability and image stability, as well as improved foil cutting properties and wrinkle resistance during transportation.

The second intermediate layer can be formed by dispersing or dissolving the above-described materials in water or a suitable solvent to prepare a coating liquid, applying the coating liquid on the first intermediate layer by known means, such as by roll coating, reverse roll coating, gravure coating, reverse gravure coating, bar coating and rod coating to form a film, and drying the film.

(Receiving Layer)

The receiving layer contains at least one resin material, including polyolefins, vinyl resins, (meth)acrylic resins, cellulose resins, polyesters, polyamides, polycarbonates, styrene resins, and polyurethanes.

The content of the resin material in the receiving layer is preferably 50% by mass or more and 99% by mass or less, more preferably 70% by mass or more and 95% by mass or less. When the content is within the range, the receiving layer can provide a good image formed thereon.

In one embodiment, the receiving layer contains one or two or more silicone oils. When the receiving layer contains silicone oils, releasability between the thermal transfer sheet and the receiving layer during image formation can be improved.

Examples of the silicone oils include straight silicone oils such as dimethyl silicone oils and methylphenyl silicone oils, as well as modified silicone oils such as amino-modified silicone oils, epoxy-modified silicone oils, carboxy-modified silicone oils, methacryl-modified silicone oils, mercapto-modified silicone oils, carbinol-modified silicone oils, fluorine-modified silicone oils, methyl styryl-modified silicone oils, and polyether-modified silicone oils.

The content of the silicone oils in the receiving layer is preferably 0.1% by mass or more and 10% by mass or less, more preferably 1% by mass or more and 5% by mass or less. When the content is within the range, releasability between the thermal transfer sheet and the receiving layer during image formation can be further improved.

Within a range not impairing the characteristics of the present invention, the receiving layer can contain the additives described above.

The thickness of the receiving layer is preferably 0.5 μm or more and 4.5 μm or less, more preferably 1 μm or more and 3 μm or less. When the thickness is within the range, the receiving layer can provide a good image formed thereon, while maintaining the foil cutting properties of the intermediate transfer medium.

The sum of the thickness of the second intermediate layer and the thickness of the receiving layer is preferably 1 μm or more and 9 μm or less, more preferably 2 μm or more and 6 μm or less. When the sum of the thicknesses is within the range, the intermediate transfer medium can have further improved smudge resistance and image stability.

The receiving layer can be formed by dispersing or dissolving the above-described materials in water or a suitable solvent to prepare a coating liquid, applying the coating liquid on the second intermediate layer by known means, such as by roll coating, reverse roll coating, gravure coating, reverse gravure coating, bar coating and rod coating to form a film, and drying the film.

(Peeling Layer)

In one embodiment, the transfer layer provided in the intermediate transfer medium of the present invention includes a peeling layer under the first intermediate layer. This can improve the transfer properties of the transfer layer.

In one embodiment, the peeling layer contains one or two or more resin materials, including (meth)acrylic resins, cellulose resins, vinyl resins, polyurethanes, silicone resins and fluorine resins.

Among them, (meth)acrylic resins are preferable from the viewpoint of durability and foil cutting properties of the intermediate transfer medium.

The peeling layer contains a resin material having a Tg preferably of 105° C. or lower, more preferably of 60° C. or higher and 105° C. or lower. When the peeling layer contains such a resin material, the intermediate transfer medium can have further improved durability and improved foil cutting properties.

The content of the resin material in the peeling layer is preferably 50% by mass or more and 90% by mass or less, more preferably 70% by mass or more and 85% by mass or less. When the content is within the range, the transfer layer can have improved transfer properties.

In one embodiment, the peeling layer contains one or two or more waxes, including natural waxes such as bees wax, spermaceti, japan wax, rice wax, carnauba wax, candelilla wax and montan wax; synthetic waxes such as paraffin wax, microcrystalline wax, oxidized wax, ozokerite, ceresin, ester wax and polyethylene wax; higher saturated fatty acids such as margaric acid, lauric acid, myristic acid, palmitic acid, stearic acid, furoic acid and behenic acid; higher saturated monohydric alcohols such as stearyl alcohol and behenyl alcohol; monohydric alcohols such as sorbitan fatty acid ester; and higher fatty acid amides such as stearic acid amide and oleic acid amide.

The content of the wax in the peeling layer is preferably 0.1% by mass or more and 10% by mass or less, more preferably 1% by mass or more and 8% by mass or less. When the content is within the range, the transfer layer can have improved transfer properties.

In one embodiment, the peeling layer contains one or two or more ultraviolet absorbers. When the peeling layer contains one or two or more ultraviolet absorbers, images formed on the receiving layer can have improved light resistance and weather resistance. Examples of the ultraviolet absorbers include benzophenone compounds, benzotriazole compounds and ultraviolet-absorbing resins.

The content of the ultraviolet absorbers in the peeling layer is preferably 0.1% by mass or more and 10% by mass or less, more preferably 1% by mass or more and 8% by mass or less. When the content is within the range, images formed on the receiving layer can have further improved light resistance and weather resistance.

Within a range not impairing the characteristics of the present invention, the peeling layer can contain the additives described above.

The peeling layer may have any thickness, e.g., 0.1 μm or more and 5.0 μm or less.

The peeling layer can be formed by dispersing or dissolving the above-described materials in water or a suitable solvent, applying the dispersion or solution on a substrate or the like by known means, such as by roll coating, reverse roll coating, gravure coating, reverse gravure coating, bar coating and rod coating to form a film, and drying the film.

(Release Layer)

In one embodiment, the intermediate transfer medium of the present invention includes a release layer between the substrate and the transfer layer. This can improve the transfer properties of the transfer layer.

In one embodiment, the release layer contains one or two or more resin materials, including (meth)acrylic resins, polyurethanes, acetal resins, polyamides, polyesters, melamine resins, polyol resins, cellulose resins and silicone resins.

In one embodiment, the release layer contains one or two or more mold lubricants, including silicone oils, phosphate plasticizers, fluorine compounds, waxes, metal soaps, and fillers.

The release layer may have any thickness, e.g., 0.2 μm or more and 2.0 μm or less.

The release layer can be formed by dispersing or dissolving the above-described materials in water or a suitable solvent, applying the dispersion or solution on the substrate by known means, such as by roll coating, reverse roll coating, gravure coating, reverse gravure coating, bar coating and rod coating to form a film, and drying the film.

(Backing Layer)

In one embodiment, the intermediate transfer medium of the present invention includes a backing layer on the surface of the substrate opposite to the surface provided with the transfer layer.

In one embodiment, the backing layer contains one or two or more resin materials, including cellulose resins, styrene resins, vinyl resins, polyesters, polyurethanes, silicone modified polyurethanes, fluorine modified polyurethanes, and (meth)acrylic resins.

In one embodiment, the backing layer contains inorganic or organic particles. When the backing layer contains inorganic or organic particles, sticking or wrinkling due to heating during thermal transfer can be further prevented.

Examples of the inorganic particles include those composed of clay minerals such as talc and kaolin, carbonates such as calcium carbonate and magnesium carbonate, hydroxides such as aluminum hydroxide and magnesium hydroxide, sulfates such as calcium sulfate, oxides such as silica, graphite, niter, and boron nitride. Examples of the organic particles include organic resin particles composed of (meth)acrylic resins, TEFLON® resins, silicone resins, lauroyl resins, phenol resins, acetal resins, styrene resins and polyamides, and cross-linked resin particles obtained by reacting them with a cross-linking agent.

The backing layer may have any thickness, e.g., 0.1 μm or more and 2 μm or less.

The backing layer can be formed by dispersing or dissolving the above-described materials in water or a suitable solvent, applying the dispersion or solution on the substrate by known means, such as by roll coating, reverse roll coating, gravure coating, reverse gravure coating, bar coating and rod coating to form a film, and drying the film.

EXAMPLES

The present invention will be described in more detail below with reference to Examples, but is not limited thereto.

Example 1

A PET film having a thickness of 12 μm (LUMIRROR® 12F65K, produced by Toray Industries, Inc.) was prepared as a substrate. A coating liquid for forming a peeling layer which had a composition described below was applied to one surface of the PET film and dried to form a peeling layer having a thickness of 1 μm.

<Coating Liquid for Forming Peeling layer>

| | |
|---|---|
| (Meth)acrylic resin A (Mitsubishi Chemical Corporation, DIANAL ® BR-87, Tg: 105° C., Mw: 25,000) | 80 parts by mass |
| Polyester (TOYOBO CO., LTD., VYLON ® 200) | 5 parts by mass |
| Polyethylene wax (Toyo Adl Corporation, POLYWAX 1000) | 5 parts by mass |
| Ultraviolet-absorbing resin (Sannan Chemical Industry Co., Ltd., PUVA-50M-40TM, Solid content: 40%) | 25 parts by mass |
| Toluene | 192.5 parts by mass |
| Methyl ethyl ketone (MEK) | 192.5 parts by mass |

A coating liquid for forming a first intermediate layer which had a composition described below was applied to the peeling layer and dried to form a first intermediate layer having a thickness of 2 μm. The molar equivalent ratio (—NCO/—OH) of isocyanate groups in the below-mentioned isocyanate compound to hydroxy groups in the below-mentioned (meth)acrylic polyol resin was 0.5.

<Coating Liquid for Forming First Intermediate Layer>

| | |
|---|---|
| (Meth)acrylic polyol resin A (Taisei Fine Chemical Co., Ltd., 6KW-700, Solid content: 36.5%, Tg: 102° C., Mw: 55,000, Hydroxyl value: 30.1) | 100 parts by mass |
| Isocyanate compound (Mitsui Chemicals, Incorporated, TAKENATE ® D110N, Solid content: 75%) | 3.6 parts by mass |
| MEK | 92 parts by mass |

A coating liquid for forming a second intermediate layer which had a composition described below was applied to the first intermediate layer and dried to form a protective layer having a thickness of 2 μm.

<Coating Liquid for Forming Second Intermediate Layer>

| | |
|---|---|
| Polyester A (TOYOBO CO., LTD., VYLON ® 200, Tg: 67° C., Mn: 17,000) | 78.4 parts by mass |
| Filter A (NIPPON SHOKUBAI CO., LTD., EPOSTAR ® MA1002, Mean particle diameter: 2 μm, (meth)acrylic resin particle, spherical) | 1.6 parts by mass |
| MEK | 20 parts by mass |

A coating liquid for forming a receiving layer which had a composition described below was applied to the second intermediate layer and dried to form a receiving layer having a thickness of 2 μm and thus provide an intermediate transfer medium.

<Coating Liquid for Forming Receiving layer>

| | |
|---|---|
| Vinyl chloride-vinyl acetate copolymer (Nissin Chemical Industry Co., Ltd., SOLBIN ® CNL) | 95 parts by mass |
| Epoxy-modified silicone oil (Shin-Etsu Chemical Co., Ltd., KP-1800U) | 5 parts by mass |
| Toluene | 200 parts by mass |
| MEK | 200 parts by mass |

Example 2

An intermediate transfer medium was prepared in the same manner as in Example 1 except that the filler A contained in the coating liquid for forming a second intermediate layer was changed to a filler B (Fuji Silysia Chemical Ltd., SYLYSIA® 310P, Mean particle diameter: 2.7 μm, silica particle, amorphous).

Example 3

An intermediate transfer medium was prepared in the same manner as in Example 1 except that the filler A contained in the coating liquid for forming a second intermediate layer was changed to a filler C (Momentive Performance Materials Inc., TOSPEARL® 120, Mean particle diameter: 2 μm, silicone resin particle, spherical).

Example 4

An intermediate transfer medium was prepared in the same manner as in Example 1 except that the filler A contained in the coating liquid for forming a second intermediate layer was changed to a filler D (Momentive Performance Materials Inc., TOSPEARL® 240, Mean particle diameter: 4 μm, silicone resin particle, amorphous).

Example 5

An intermediate transfer medium was prepared in the same manner as in Example 1 except that the composition of the coating liquid for forming a second intermediate layer was changed as described below.

<Coating Liquid for Forming Second Intermediate Layer>

| | |
|---|---|
| Polyester A | 76 parts by mass |
| Filler A | 4 parts by mass |
| MEK | 20 parts by mass |

Example 6

An intermediate transfer medium was prepared in the same manner as in Example 1 except that the polyester A contained in the coating liquid for forming a second intermediate layer was changed to a polyester B (TOYOBO CO., LTD., VYLON® 600, Tg: 47° C., Mn: 16,000).

Example 7

An intermediate transfer medium was prepared in the same manner as in Example 1 except that the polyester A contained in the coating liquid for forming a second intermediate layer was changed to a polyester C (TOYOBO CO., LTD., VYLON® 290, Tg: 72° C., Mn: 22,000).

Example 8

An intermediate transfer medium was prepared in the same manner as in Example 1 except that the polyester A contained in the coating liquid for forming a second intermediate layer was changed to a polyester D (Toyobo Co., Ltd., GK 880, Tg: 84° C., Mn: 18,000).

Example 9

An intermediate transfer medium was prepared in the same manner as in Example 1 except that the composition of the coating liquid for forming a first intermediate layer was changed as described below such that the molar equivalent ratio (—NCO/—OH) of isocyanate groups in the isocyanate compound to hydroxy groups in the (meth)acrylic polyol resin was 3.

<Coating Liquid for Forming First Intermediate Layer>

| | |
|---|---|
| (Meth)acrylic polyol resin A | 100 parts by mass |
| Isocyanate compound (Mitsui Chemicals, Incorporated, TAKENATE ® D110N, Solid content: 75%) | 21.6 parts by mass |
| MEK | 92 parts by mass |

Example 10

An intermediate transfer medium was prepared in the same manner as in Example 1 except that the (meth)acrylic resin A contained in the coating liquid for forming a peeling layer was changed to a (meth)acrylic resin B (Mitsubishi Chemical Corporation, DIANAL® BR-113, Tg: 75° C., Mn: 30,000).

Comparative Example 1

An intermediate transfer medium was prepared in the same manner as in Example 1 except that the composition of the coating liquid for forming a second intermediate layer was changed as described below.

<Coating Liquid for Forming Second Intermediate Layer>

| | |
|---|---|
| Polyester A (TOYOBO CO., LTD., VYLON ® 200, Tg: 67° C., Mn: 17,000) | 80 parts by mass |
| MEK | 20 parts by mass |

Comparative Example 2

An intermediate transfer medium was prepared in the same manner as in Example 1 except that the polyester A contained in the coating liquid for forming a second intermediate layer was changed to a polyester a (TOYOBO CO., LTD., GK 780, Tg: 35° C., Mn: 11,000).

Comparative Example 3

An intermediate transfer medium was prepared in the same manner as in Example 1 except that the composition of the coating liquid for forming a first intermediate layer was changed as described below.

<Coating Liquid for Forming First Intermediate Layer>

| | |
|---|---|
| (Meth)acrylic polyol resin a (NIPPON SHOKUBAI CO., LTD., UV-G137, Solid content: 40%, Tg: 70° C., Hydroxyl value: 52.5) | 100 parts by mass |
| Isocyanate compound (Mitsui Chemicals, Incorporated, TAKENATE ® D110N, Solid content: 75%) | 6.85 parts by mass |
| MEK | 140 parts by mass |

Comparative Example 4

An intermediate transfer medium was prepared in the same manner as in Example 1 except that the filler A contained in the coating liquid for forming a second intermediate layer was changed to a filler a (Nissan Chemical Corporation, MEK-ST, Mean particle diameter: 10 to 15 nm, silica particle, spherical).

Comparative Example 5

An intermediate transfer medium was prepared in the same manner as in Example 1 except that the filler A contained in the coating liquid for forming a second intermediate layer was changed to a filler b (Momentive Performance Materials Inc., TOSPEARL 20008, Mean particle diameter: 6 μm, silicone resin particle, spherical).

Comparative Example 6

An intermediate transfer medium was prepared in the same manner as in Example 1 except that the composition of the coating liquid for forming a second intermediate layer was changed as described below.

<Coating Liquid for Forming Second Intermediate Layer>

| | |
|---|---|
| Polyester A (TOYOBO CO., LTD., VYLON ® 200, Tg: 67° C., Mn: 17,000) | 79.76 parts by mass |
| Filler A (NIPPON SHOKUBAI CO., LTD., EPOSTAR ® MA1002, Mean particle diameter: 2 μm, (meth)acrylic resin particle, spherical) | 0.24 parts by mass |
| MEK | 20 parts by mass |

Comparative Example 7

An intermediate transfer medium was prepared in the same manner as in Example 1 except that the composition of the coating liquid for forming a second intermediate layer was changed as described below.

<Coating Liquid for Forming Second Intermediate Layer>

| | |
|---|---|
| Polyester A (TOYOBO CO., LTD., VYLON ® 200, Tg: 67° C., Mn: 17,000) | 73.6 parts by mass |
| Filler A (NIPPON SHOKUBAI CO., LTD., EPOSTAR ® MA1002, Mean particle diameter: 2 μm, (meth)acrylic resin particle, spherical) | 6.4 parts by mass |
| MEK | 20 parts by mass |

Comparative Example 8

An intermediate transfer medium was prepared in the same manner as in Example 1 except that the compositions of the coating liquid for forming a second intermediate layer and the coating liquid for forming a receiving layer were changed as described below.

<Coating Liquid for Forming Second Intermediate Layer>

| | |
|---|---|
| Polyester A (TOYOBO CO., LTD., VYLON ® 200, Tg: 67° C., Mn: 17,000) | 80 parts by mass |
| MEK | 20 parts by mass |
| <Coating Liquid for Forming Receiving layer> | |
| Vinyl chloride-vinyl acetate copolymer (Nissin Chemical Industry Co., Ltd., SOLBIN ® CNL) | 90.25 parts by mass |
| Epoxy-modified silicone oil (Shin-Etsu Chemical Co., Ltd., KP-1800U) | 4.75 parts by mass |
| Filler A | 5 parts by mass |
| Toluene | 200 parts by mass |
| MEK | 200 parts by mass |

<<Evaluation of Smudge Resistance>>

An image was formed on a receiving layer provided in the intermediate transfer mediums obtained in Examples and Comparative Examples described above using a sublimation thermal transfer printer (Dai Nippon Printing Co., Ltd., DS621) and a genuine thermal transfer sheet for the printer (Dai Nippon Printing Co., Ltd.).

After the image formation, transfer of the transfer layer provided in the intermediate transfer medium onto a polyvinyl chloride card (hereinafter referred to as PVC card) produced by Dai Nippon Printing Co., Ltd. was performed with a laminator including a heating roller and a platen roller at a transfer temperature of 170° C. and a transfer rate of 0.5 inch/sec to obtain a printed matter. The printed matter prepared was visually inspected and evaluated according to the evaluation criteria described below (printed matter A).

In addition, a printed matter was prepared and evaluated in the same manner as described above except that the transfer rate was changed to 1.0 inch/sec (printed matter B).

Figure 5:
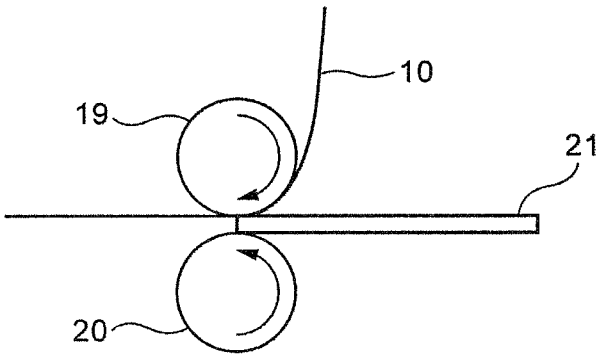
FIGS. 5(*a*), 5(*b*) and 5(*c*) are schematic views illustrating production of printed matters for the evaluation for prevention of smudge in Examples.
Figure 5:
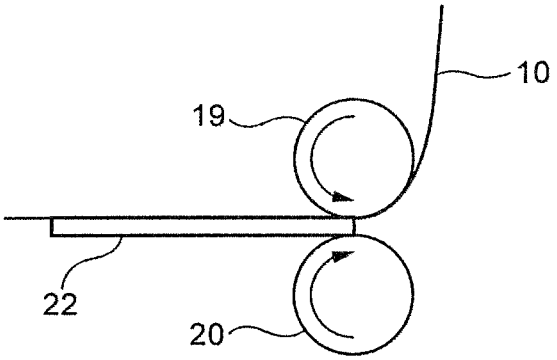
Figure 5:
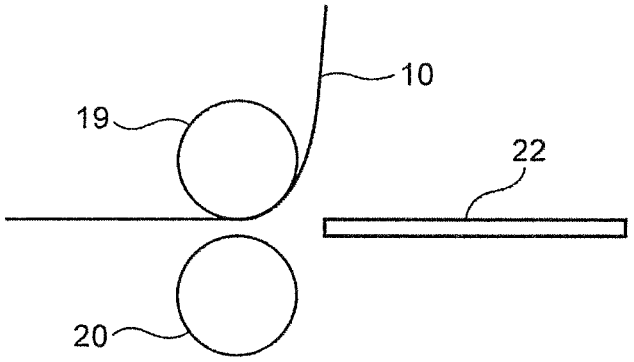

Further, a printed matter was prepared and evaluated in the same manner as described above except that the transfer rate was changed to 1.0 inch/sec, and the transport directions of the transfer object and the obtained printed matter was changed (printed matter C). Specifically, a transfer layer provided in an intermediate transfer medium 10 was transferred onto a PVC card 21 with a laminator including a heating roller 19 and a platen roller 20 as shown in FIG. 5(*a*). As a result, a printed matter 22 was produced as shown in FIG. 5(*b*). Then, the rotation directions of the heating roller 19 and the platen roller 20 were changed to discharge the printed matter 22 as shown in FIG. 5(*c*). Table 1 summarizes the evaluation results.

(Evaluation Criteria)

A: No Smudge observed on the surface of the printed matter

B: Slight but not practically problematic Smudge observed on the surface of the printed matter NG: Practically problematic Smudge observed on the surface of the printed matter <<Evaluation of Wear Resistance>>

The printed matter A was worn 250 times at a load of 500 g using a wear ring CS-10. The printed matter after being worn was visually inspected and evaluated according to the evaluation criteria described below. Table 1 summarizes the evaluation results.

(Evaluation Criteria)

A: No flaws observed on the surface.

B: Slight but not practically problematic flaws observed on the surface.

NG: Many and practically problematic flaws observed on the surface.

<<Evaluation of Solvent Resistance>>

The surface of the printed matter A was rubbed back and forth 10 times with a load of 200 g with a cotton cloth impregnated with 0.5 mL of isopropanol, using a Gakushin-Type fastness to rubbing tester (TESTER SANGYO CO., LTD., AB-301), under an environment having a temperature of 22.5° C. and a humidity of 40%. The printed matter after rubbing was visually inspected and evaluated according to the evaluation criteria described below. Table 1 summarizes the evaluation results.

(Evaluation Criteria)

A: No defects observed in the image formed on the printed matter.

B: Slight but not practically problematic defects observed in the image formed on the printed matter.

C: Many defects observed in the image formed on the printed matter.

<<Evaluation of Image Stability>>

The surface of the printed matter A was visually inspected and evaluated according to the evaluation criteria described below. Table 1 summarizes the evaluation results.

(Evaluation Criteria)

A: No significant ruggedness nor image unevenness due to the ruggedness observed in the surface B: Slight but not practically problematic, significant ruggedness and image unevenness due to the ruggedness observed in the surface NG: Significant ruggedness and image unevenness due to the ruggedness observed in the surface <<Evaluation of Foil Cutting Properties>>

The printed matter A was visually inspected and evaluated according to the evaluation criteria described below. Table 1 summarizes the evaluation results.

(Evaluation Criteria)

A: Less than 1 mm of tailing

B: 1 mm or more and less than 2 mm of tailing

C: 2 mm or more of tailing

<<Evaluation of Wrinkle Resistance during Transportation>>

The surface (edge face) of the printed matter B was visually inspected and evaluated according to the evaluation criteria described below. Table 1 summarizes the evaluation results.

(Evaluation Criteria)

A: No wrinkles observed.

B: Slight but not practically problematic, due to the size of less than 1 mm, wrinkles observed.

C: Practically problematic wrinkles having a size of 1 mm or more observed.

TABLE 1

| | composition of peeling layer (% by mass) (meth)acrylic resin | | composition of first intermediate layer (% by mass) (meth)acrylic polyol resin | | composition of second intermediate layer (% by mass) | | | | | | | |
|---|---|---|---|---|---|---|---|---|---|---|---|---|
| | | | | | polyester | | | | | filler | | |
| | A (Tg: 105° C.) | B (Tg: 75° C.) | A (Tg: 102° C.) | a (Tg: 70° C.) | A (Tg: 67° C.) | B (Tg: 47° C.) | C (Tg: 72° C.) | D (Tg: 84° C.) | a (Tg: 35° C.) | A (mean particle diameter: 2 μm) (styrene-(meth)acrylic ester copolymer particle) (spherical) | B (mean particle diameter: 2.7 μm) (silica particle) (amorphous) | C (mean particle diameter: 2 μm) (silicone resin particle) (spherical) |
| Example 1 | 80 | | 93.1 | | 98 | | | | | 2 | | |
| Example 2 | 80 | | 93.1 | | 98 | | | | | | 2 | |
| Example 3 | 80 | | 93.1 | | 98 | | | | | | | 2 |
| Example 4 | 80 | | 93.1 | | 98 | | | | | | | |
| Example 5 | 80 | | 93.1 | | 95 | | | | | 5 | | |
| Example 6 | 80 | | 93.1 | | | 98 | | | | 2 | | |
| Example 7 | 80 | | 93.1 | | | | 98 | | | 2 | | |

TABLE 1-continued

| | | | | | | | | | | | |
|---|---|---|---|---|---|---|---|---|---|---|---|
| Example 8 | 80 | | 93.1 | | | | 98 | | 2 | | |
| Example 9 | 80 | | 69.3 | | 98 | | | | 2 | | |
| Example 10 | | 80 | 93.1 | | 98 | | | | 2 | | |
| Comparative Example 1 | 80 | | 93.1 | | 100 | | | | | | |
| Comparative Example 2 | 80 | | 93.1 | | | | | 98 | 2 | | |
| Comparative Example 3 | 80 | | | 89 | 98 | | | | 2 | | |
| Comparative Example 4 | 80 | | 93.1 | | 98 | | | | | | |
| Comparative Example 5 | 80 | | 93.1 | | 98 | | | | | | |
| Comparative Example 6 | 80 | | 93.1 | | 98 | | | | 0.3 | | |
| Comparative Example 7 | 80 | | 93.1 | | 92 | | | | 8 | | |
| Comparative Example 8 | 80 | | 93.1 | | 100 | | | | | | |

| | composition of second intermediate layer (% by mass) filler | | | performance evaluation | | | | | | | |
|---|---|---|---|---|---|---|---|---|---|---|---|
| | D (mean particle diameter: 4 μm) (silicone resin particle) (amorphous) | a (mean particle diameter: 10-15 nm) (silica particle) (spherical) | b (mean particle diameter: 6 μm) (silicone resin particle) (spherical) | smudge resistance | | | | | | | wrinkle resistance |
| Table 1 | | | | printed matter A | printed matter B | printed matter C | wear resistance | solvent resistance | image stability | foil cutting properties | during trans-portation |
| Example 1 | | | | A | A | A | A | A | A | A | A |
| Example 2 | | | | A | A | A | A | B | A | A | A |
| Example 3 | | | | A | A | A | B | A | A | A | A |
| Example 4 | 2 | | | A | B | B | A | A | B | A | B |
| Example 5 | | | | A | A | A | A | A | B | A | A |
| Example 6 | | | | A | B | B | B | A | A | A | B |
| Example 7 | | | | A | A | A | A | A | A | B | A |
| Example 8 | | | | A | A | A | A | A | A | C | A |
| Example 9 | | | | B | B | B | A | A | A | B | A |
| Example 10 | | | | A | A | A | B | B | A | A | A |
| Comparative Example 1 | | | | B | NG | NG | A | A | A | A | C |
| Comparative Example 2 | | | | A | NG | NG | NG | A | A | A | D |
| Comparative Example 3 | | | | A | A | A | NG | A | A | A | A |
| Comparative Example 4 | | 2 | | B | NG | NG | A | A | A | A | D |
| Comparative Example 5 | | | 2 | B | B | B | A | A | NG | A | B |
| Comparative Example 6 | | | | B | NG | NG | A | A | A | A | D |
| Comparative Example 7 | | | | B | B | B | NG | A | NG | A | B |
| Comparative Example 8 | | | | B | B | B | NG | A | NG | A | B |

DESCRIPTION OF SYMBOLS

10: Intermediate transfer medium
11: Substrate
12: Transfer layer
13: First intermediate layer
14: Second intermediate layer
15: Receiving layer
16: Peeling layer
17: Release layer
18: Backing layer
19: Heating roller
20: Platen roller
21: PVC card
22: Printed matter

The invention claimed is:

1. An intermediate transfer medium, comprising:

a substrate; and a transfer layer comprising a first intermediate layer, a second intermediate layer and a receiving layer, wherein the first intermediate layer contains a (meth) acrylic polyol resin having a glass transition temperature of 80° C. or higher;

wherein the second intermediate layer contains a polyester having a glass transition temperature of 45° C. or higher and a filler having a mean particle diameter of 2 μm or more and 5 μm or less; and wherein the content of the filler in the second intermediate layer is 0.5% by mass or more and 5% by mass or less.

2. The intermediate transfer medium according to claim 1, wherein the filler is (meth)acrylic resin particle.

3. The intermediate transfer medium according to claim 1, wherein the shape of the filler is spherical.

4. The intermediate transfer medium according to claim 1, wherein the (meth)acrylic polyol resin is a cured (meth) acrylic polyol resin obtained by curing a (meth)acrylic polyol resin having a Tg of 80° C. or higher with a curing agent.

5. The intermediate transfer medium according to claim 4, wherein the curing agent is an isocyanate compound; and wherein the molar equivalent ratio (—NCO/—OH) of isocyanate groups in the isocyanate compound to hydroxy groups in the (meth)acrylic polyol resin is 0.2 or more and 3 or less.

6. The intermediate transfer medium according to claim 1, wherein the glass transition temperature of the polyester is 50° C. or higher and 80° C. or lower.

7. The intermediate transfer medium according to claim 1, wherein the sum of the thickness of the second intermediate layer and the thickness of the receiving layer is 1 μm or more and 9 μm or less.

* * * * *